US005245249A

United States Patent [19]

Sakurai et al.

[11] Patent Number: 5,245,249

[45] Date of Patent: Sep. 14, 1993

[54] FLAT DISPLAY DEVICE

[75] Inventors: Koichi Sakurai; Hidenobu Murakami, both of Hyogo, Japan

[73] Assignee: Mitsubishi Denki Kabushiki Kaisha, Japan

[21] Appl. No.: 840,849

[22] Filed: Feb. 25, 1992

[30] Foreign Application Priority Data

Apr. 24, 1991 [JP] Japan ..... 3-094185

[51] Int. Cl.[5] ..... H01J 23/16

[52] U.S. Cl. ..... 315/3; 315/340; 313/442; 313/497; 313/313

[58] Field of Search ..... 315/3, 340 MS File; 313/449, 448, 306, 422, 497, 313

[56] References Cited

U.S. PATENT DOCUMENTS

| | | | |
|---|---|---|---|
| 4,121,130 | 10/1978 | Gange | 313/302 |
| 4,341,980 | 7/1982 | Noguchi et al. | 315/169.1 |
| 4,647,815 | 3/1987 | Ishikawa | 315/3 |
| 4,956,578 | 9/1990 | Shimizu | 315/3 |

*Primary Examiner*—Robert J. Pascal
*Assistant Examiner*—R. A. Ratliff
*Attorney, Agent, or Firm*—Wolf, Greenfield & Sacks

[57] ABSTRACT

A flat display device includes no exposed part of an insulated substrate on the inner wall of electron pass holes for attaining a high intensity of a display screen, high operational stability of the display screen, and having a simple structure for manufacturing it easily. In a control electrode, resistive films are formed on the exposed part of an insulated body. When the electrons pass through electron pass holes, electron beams are controlled without charging the insulated substrate by the electrons.

15 Claims, 9 Drawing Sheets

FLAT DISPLAY DEVICE

BACKGROUND OF THE INVENTION

The invention relates to a flat display device using an electrical beam. More specifically the invention relates to a flat display device having a plurality of control electrodes coated with resistivity films on their surfaces.

FIG. 2 is a perspective view showing a part of the conventional flat display device disclosed in the laid-open Japanese patent publication No. 63-184239/1988. In FIG. 2, 1 is a linear hot cathode which emits the electrons by the current flowing through it. 3 is a cover electrode having holes on the surface, which shape is, for example, a part of an ellipse. The cover electrode is arranged so that it covers the linear hot cathode 1 and attracts and accelerates the hot electrons which are generated from the hot cathode 1. The cover electrode 3 has many small holes 1*a* on its surface, and attracts the hot electrons 2 from the linear hot cathode by applying appropriate electrical potential. 8 is a front glass which is coated by dot shape fluorescent materials. The dot shape fluorescent materials form a fluorescent body 9. The fluorescent body 9 is excited by the electron 2 and generates red, green and blue light. A conductive aluminum film (not shown) is formed on the surface of the fluorescent body 9. The electron 2 is accelerated by the voltage of about 5–30 kV applied to the aluminum film, and causes the fluorescent body 9 to excite and to generate light.

4 is a control electrode which is arranged between the front glass 8 and linear hot cathode 1 and also arranged substantially parallel to the linear hot cathode 1. The control electrode 4 controls the emitted electron beam, which is attracted by the cover electrode 3 and directed to the front glass 8, so that the beam can pass through or can not pass through the control electrode 4. The control electrode 4 consists of an insulated substrate 5, metal electrodes 6 and metal electrodes 7. 20 is a back electrode arranged to the opposite side of the cover electrode 3 against the linear hot cathode 1.

FIG. 3 is an exploded view of the control electrode 4. The insulated substrate 5 has electron pass holes 5*a* corresponding to the picture elements on the front glass 8. Strap-shaped metal electrodes 6 are arranged under the insulated substrate 5 corresponding to each column of the picture element. Each strap-shaped metal electrodes 6 have electron pass holes 6*a* corresponding to the picture elements. The metal electrodes 6 consist of a first control electrode group. In the same way, strap-shaped metal electrodes 7 are arranged over the insulated substrate 5 corresponding to each row of the picture elements. Each strap-shaped metal electrode 7 has electron pass holes 7*a* corresponding to the picture elements. The metal electrodes 7 consist of a second control electrode group. The first control electrode group 6 and the second control electrode group 7 are bonded so that the electron pass holes 6*a* and 7*a* are aligned with the electron pass holes 5*a* of the insulated substrate 5.

The operation of the invention is explained below. The electrons 2 emitted from the linear hot cathode 1 are attracted to the cover electrode 3 by the plus electric potential of about 2–20 volts applied to the cover electrode 3. Further, the electrons are attracted and reach the control electrode 4 by applying the plus electrical potential of about 20–50 volts to one of the electrodes of the first control electrode group 6 which is perpendicular to the linear hot cathode 1, against the linear hot cathode 1. The electron beam density is controlled to be homogeneous at the front surface of the metal electrode of the first control electrode group 6 by regulating the elliptic shape of the cover electrode 3, the position of the first control electrode group 6 and the voltage applied to each metal electrode 6.

FIG. 4 is an illustration showing a movement of the electrons attracted from the cover electrodes 3. In FIG. 4, the electrons 2 do not always enter into the control electrode vertically, since each electron has different initial velocity when it is attracted from the cover electrode 3. Therefore, some electrons 2*a* enter vertically into the control electrode 4 and some electrons 2*b* enter obliquely into the control electrode 4.

The operation of the control electrode 4 is not described in the laid-open patent publication No. 63-184239/88, but it is described in detail in the laid-open patent publication No. 62-172642/86 or No. 2-126688/90.

In FIG. 3, if the plus electric potential is applied to one of the control electrode group 6 and minus electric potential is applied to the other control electrode group 6, the hot electrons emitted from the linear hot cathode are attracted to only one of the metal electrode and pass through each electron pass hole and enter into the electron pass hole 5(*a*) of the insulated substrate 5. But all electrons entered into the electron pass hole 5*a* do not always pass through to the front glass 8.

FIG. 5 is an illustration showing a movement of the electrons passing through the control electrode 4. In FIG. 3, electrodes are not formed on the inner wall surface of the electron pass hole 5*a*. But in FIG. 5, the electrodes are formed on the inner wall surface of the electron pass hole 5*a*. In FIG. 5(*a*), the second control electrode 7*x* is formed on the surface of the substrate 5 at the wall of the electron pass hole 5*a*. Since zero volts or minus volts are applied to the second control electrode 7*x*, the negative potential area 10 is formed in the electron pass hole 5*a*. Therefor, the electrons 2 stop in the electron pass hole 5*a*. In FIG. 5(*b*), plus voltage is applied to the second control electrode 7*x*. The electrons which enter vertically into the substrate 5 pass through the electron pass hole 5*a*. But some electrons which enter obliquely into the electron pass hole 5*a* hit the substrate 5 and charge up the substrate 5, because a part of the substrate is exposed to the wall surface of the electron pass hole 5*a*.

FIG. 6 is an illustration showing a movement of the electrons passing through the control electrode 4. In FIG. 6(*a*), the electrons 2 pass through the electron pass hole 5*a* when the voltage of 40 to 100 volts are applied to the second control electrode 7 arranged on the top surface of the electron pass hole 5*a*. But as shown in FIG. 6(*b*), some electrons hit the exposed insulated substrate 5 and charge up the insulated substrate 5 if the electrons enter obliquely to the control electrode 4.

From FIG. 5 and FIG. 6, it is understood that the electrons can pass through the cross point where the plus electrical potential is applied to both the first control electrode 6 and the second control electrode 7. The electrons passed through the control electrode 4 hit the picture elements on the fluorescent body 9 corresponding to the cross points. Then, the fluorescent body 9 generates light and causes the picture on the display. Therefore, a desired picture is obtained by controlling the voltage applied to each metal electrode 6 and 7 corresponding to the desired cross points.

It is necessary that the control electrode 4 interrupts the electron beam to pass through when the small minus voltage is applied to the control electrode 4, or the control electrode 4 causes the electron beam to pass through when the appropriate plus voltage is applied to the control electrode 4. To achieve the above controlling feature, the control electrode 4 must be formed by an appropriate shape.

As described above, since the prior art flat display device is constructed of the strap-shaped electrode having the first control electrodes arranged in a column and the second control electrodes arranged in a row, it is difficult to bond the two types of strap-shaped electrodes which are separately manufactured. The most actual resolving method is to manufacture the control electrode 4 using a general printed wiring substrate. For example, one of the method for manufacturing the control electrode 4 is to form the conductive thin film on the surface of the insulated substrate 5 and on the inner wall surface of the electron pass hole 5*a* by a plating process, and then to eliminate the thin film at the desired position by an etching process.

FIG. 7 is one of the prior art manufacturing methods of the control electrode disclosed in the laid-open patent publication No. 58-46562/81, which construction is explained below. As shown in FIG. 7(*a*) and FIG. 7(*b*), at first the conductive films 43 and 53 are formed on the insulated substrate 41 and 51, respectively, then the electron pass holes 42 and 52 are formed in a row or column, respectively, and then the conductive films are formed on the inner wall surfaces of the electron pass holes, respectively. As shown in FIG. 7(*c*), the two substrates are bonded by the insulated materials 61 and 62 which function as insulated spacers. FIG. 7(*c*) shows a sectional view at A—A line of FIG. 7(*a*) and FIG. 7(*b*). As shown in FIG. 7, in the prior art construction of the control electrode, since the insulated spacers 61 and 62 are exposed at the inner wall of the electron pass hole, the insulated spacers 61 and 62 are charged by the incoming electrons. The charged insulated material existing near the electron pass hole causes many harmful effects to the display device as shown below.

First of all, the intensity of the display degrades. FIG. 8 is an illustration showing a movement of the electrons passing through the control electrode 4. As shown in FIG. 8(*a*), when the insulated substrate 5 is charged, the minus potential area 10 is formed by the negative charge 11 stored at the surface of the insulated material. Therefore, the area where the electrons pass through is substantially narrowed, and the current beam decreases at the electron pass hole even if the hole aperture is the same. Accordingly the intensity of the display screen degrades.

We made two control electrodes in which the exposure distance d of the insulated material shown in FIG. 8(*a*) is 100 μm (board thickness 600 μm) and 50 μm, respectively, using free-cutting ceramic substrate and conductive electrode deposited by Ni. The result of the comparison with the two model control electrodes showed about ten times difference regarding the screen intensity (candela conversion) under the same condition. For degrading the influence of the charge, it is able to apply the high voltage to the electrodes 6 and 7. But, in order to obtain a dynamic screen, it is necessary to apply a signal to the electrodes 6 and 7 at least several kHz. Considering the application to the mass production goods such as a television set, to apply a high voltage to the control electrode is not a good method.

Second, the operation of the display screen is not stable. More specifically, since it takes a lot of time until the charge quantity becomes a predetermined value, it takes a lot of time until the display screen operates in a comparatively stable state after closing the switch of the display device. It took about several tens of minutes until the above model electrode (exposure distance d=100 μm) had operated in a stable state. After the time, there occurred many irregular discharges from the charged insulated material at every place in the electrode and also occurred the flicker in the display screen.

In the laid-open patent publication No. 58-46562/81, in order to avoid the harmful influence of the charge up of the above insulated material, the resolving idea is described where spacers are arranged so as to be retracted from the inner wall of the electron pass hole. But as long as the insulated materials are exposed in the inner wall, it is very difficult to avoid the influence of the charge completely.

As already described in FIG. 4 and FIG. 5, the incidence of the electrons to the surface of the electron pass hole can not be avoided, since there is a velocity component toward the radial direction of the electron pass hole of the electron. Since the degree of vacuum of the vacuum part of the electron picture display device is about $10^{-7}$ Torr, for example, in the case of the television set, therefore, it is very difficult to cause the electrons to discharge from the charged insulated material through the vacuum part.

Even if the harmful influence is avoided by arranging the insulated substrate 5 so as to be retracted from the inner wall of the electron pass hole, it is very difficult to actually mass-produce the control electrode 4 having such construction. FIG. 9 is an enlarged sectional view of the prior art control electrode. FIG. 9(*a*) is a top view of the control electrode 4. FIG. 9(*b*) is a B—B line cross sectional diagram of FIG. 9(*a*).

In the figure, the actual manufacturing of the control electrode is described below. Assume that the diameter of the picture element is 0.6 mm, the diameter of the electron pass hole is 0.4 mm, the retracted distance from the inner wall surface of the electron pass hole is over 50 μm, the arranging range (indicated in W) of the insulated substrate 5 is only 100 μm. It is very difficult to manufacture the insulated substrate 5 within the above range in good yield and in good accuracy through the all area of the screen (about 20 inch square) of the television set. The largest reason of the difficulties is in that picture elements amount to about 300,000 through the entire area of the 20 inch display screen. Only one of the defective picture elements degrades a commercial value of the display device.

In order to decrease the harmful influence generated by charging the insulated substrate, it is able to shorten the exposure distance d of the insulated material as shown in FIG. 8(*a*). But, in order to neglect the harmful influence, the exposure distance d of the insulated material must be narrower than several tens μm. But, in case of very narrow exposure distance, the insulation between the upper electrode 6 and the lower electrode 7 will deteriorate. Therefore, the exposure distance must be formed accurately within the predetermined range lower than several tens μm on the inner wall having the hole depth (=substrate thickness) of several hundreds μm. As described above, it is also very difficult to manufacture the insulated substrate 5 within the above range in good yield for all picture elements of about 300,000.

SUMMARY OF THE INVENTION

In the flat display device of the present invention, resistive films are formed on the exposure parts of the insulated body at the electron pass hole of the control electrode. Further, the resistive films of the control electrode are formed using a semiconductor. Further, in the control electrode, conductive films are formed on the inner wall of the electron pass hole or surface of the insulated substrate, then resistive films are formed on the conductive film. Further, in the control electrode, resistive films are formed on the inner wall of the electron pass hole or surface of the insulated substrate, then conductive films are formed on the conductive film.

In the control electrode of the flat display device of the present invention, since the resistive films are formed on the exposure part of the insulated substrate at the electron pass hole, there is no charge on the exposure insulated substrate, the increased electron passing ratio through the electron pass hole causes a high intensity of the display screen, and the operation of the display screen becomes stable.

Further it is easy to mass-produce the control electrode since there is no need to control the exposure distance of the insulated substrate while producing the control electrode.

Therefore, it is an object of the present invention to provide a flat display device having no exposed part of the insulated substrate on the inner wall of the electron pass hole for attaining high intensity of the display screen, high operational stability of the display screen.

It is another object of the present invention to provide a flat display device having a simple structure for manufacturing it easily.

DETAILED DESCRIPTION OF THE PREFERRED EMBODIMENTS

First Embodiment

A first embodiment of the present invention is explained hereinafter.

Figure 1:
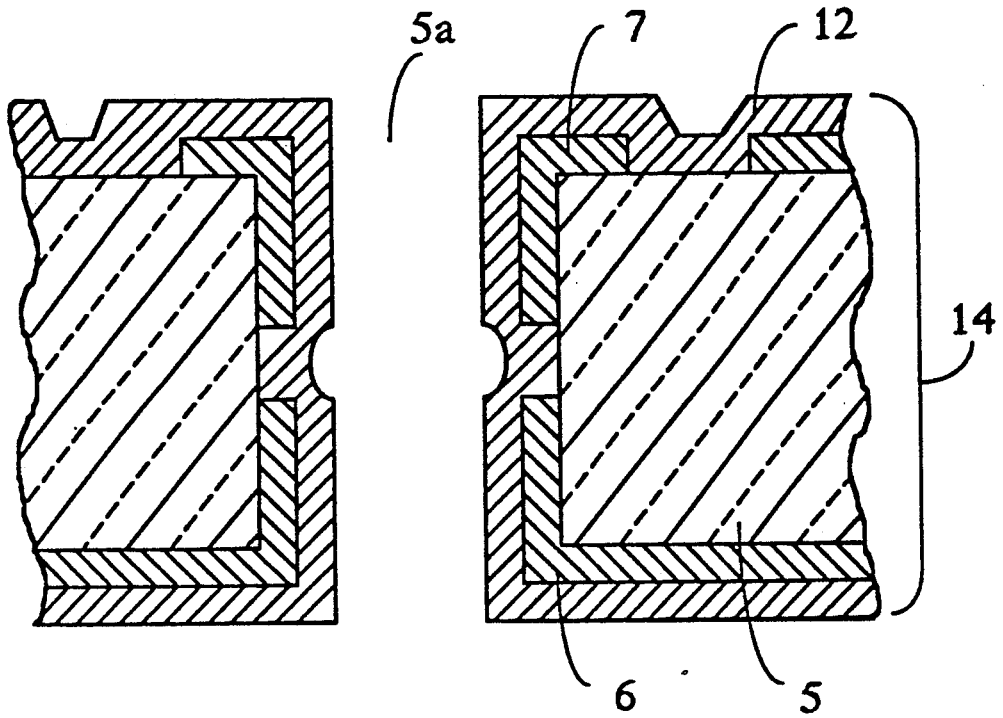
FIG. 1*a* and 1*b* are sectional views of one electron pass hole of the control electrode embodying the display device of the present invention.
Figure 1:
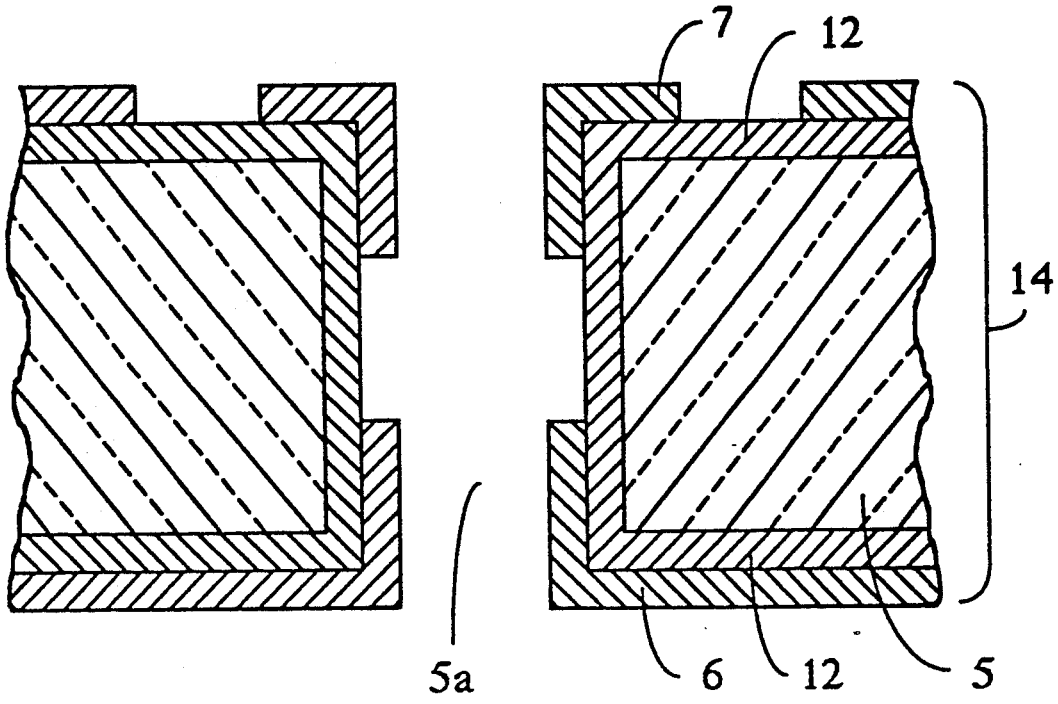
Figure 2:
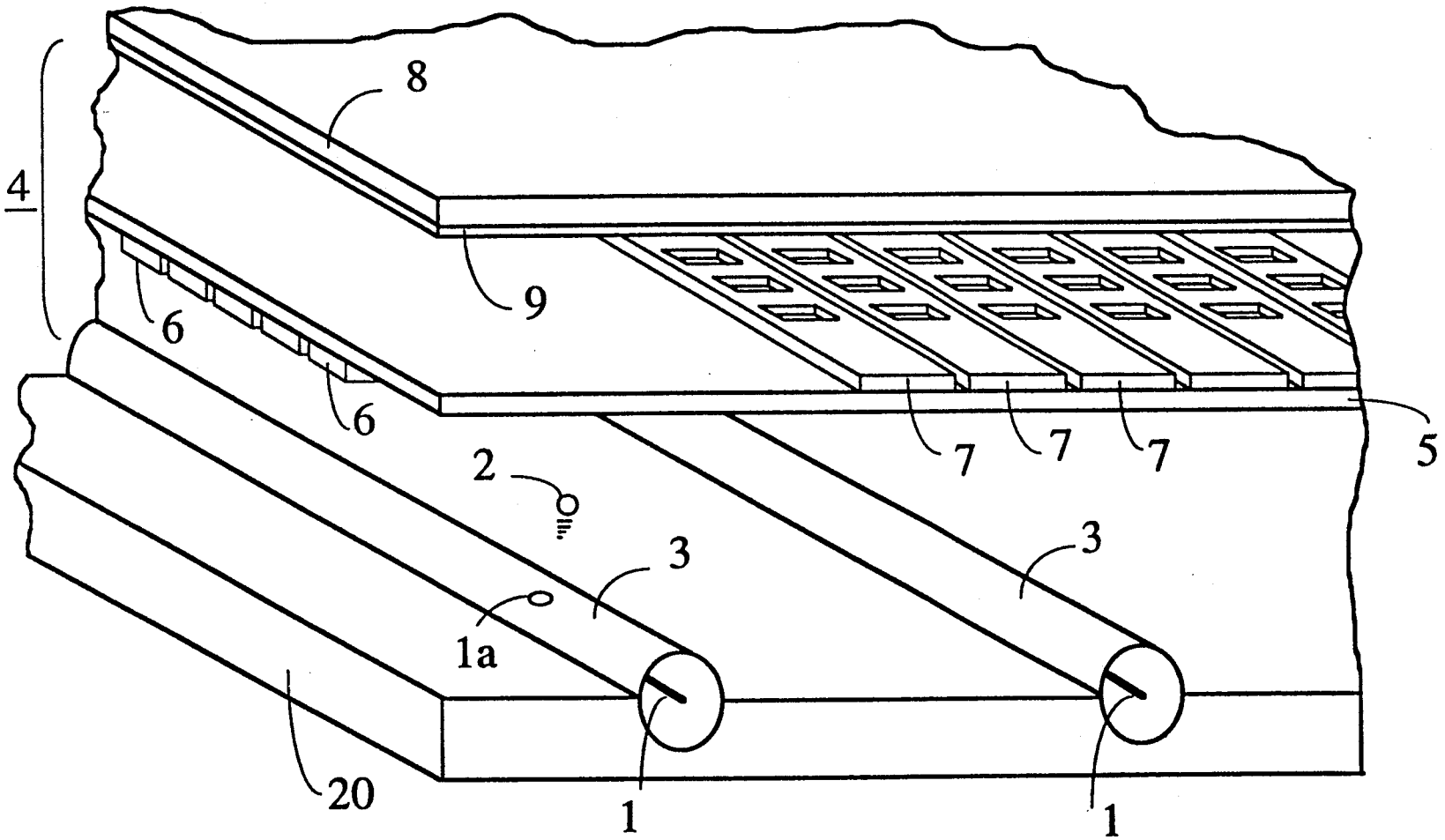
FIG. 2 (PRIOR ART)
FIG. 2 is a perspective view showing a part of the conventional flat display device.
Figure 3:
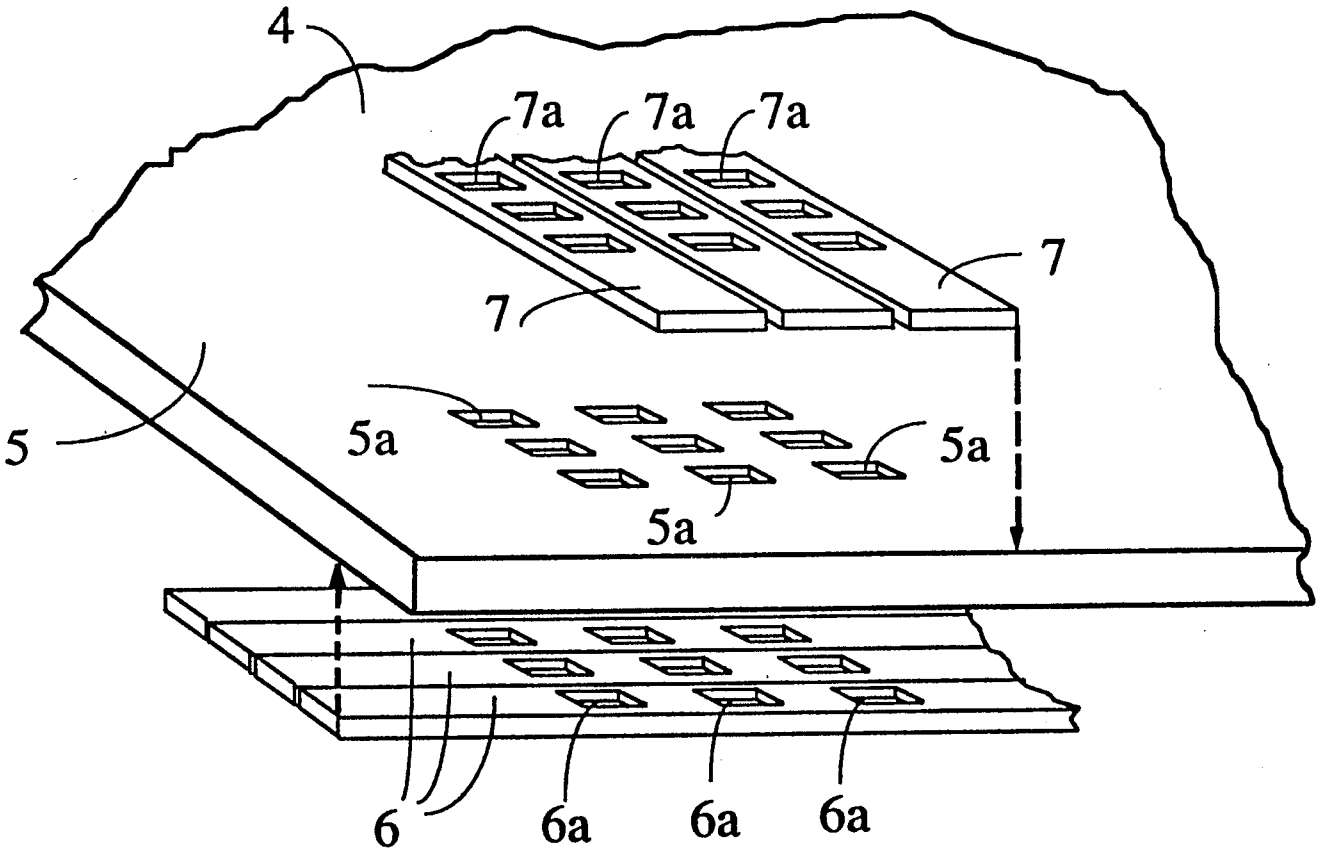
FIG. 3 (PRIOR ART)
FIG. 3 is a exploded view of the control electrode 4.

FIG. 1 is a sectional view of one electron pass hole of the control electrode 14 embodying the display device of the present invention. In FIG. 1, 6 is a first control electrode, 7 is a second control electrode, 12 is amorphous silicon film having the resistivity of $10^5$ Ωcm, 5 is a surface of the insulated substrate, 5*a* is a electron pass hole.

The construction and the operation of the flat display device of the present invention is almost the same as the prior art flat display device. But, regarding the control electrode, the present invention is different from the prior art in that the resistive film 12 of the amorphous silicon film is formed on the wall of the electron pass hole 5*a* and the insulated substrate is not exposed at the surface of the electron pass hole. The control electrode 14 is arranged between the front glass 8 and linear hot cathode 1 as same as the prior art. The control electrode has many electron pass holes corresponding to each picture element of the screen, and causes the electrons attracted by the cover electrode 3 to pass through or to interrupt to pass toward the front glass 8. The electrons 2 passed through the control electrode cause the fluorescent body 9 to generate light and indicate a desired picture on the screen. The dot and the pitch of the fluorescent body 9 of the front glass 8 are formed corresponding to the electron pass holes 16 of the control electrode 14.

Figure 4:
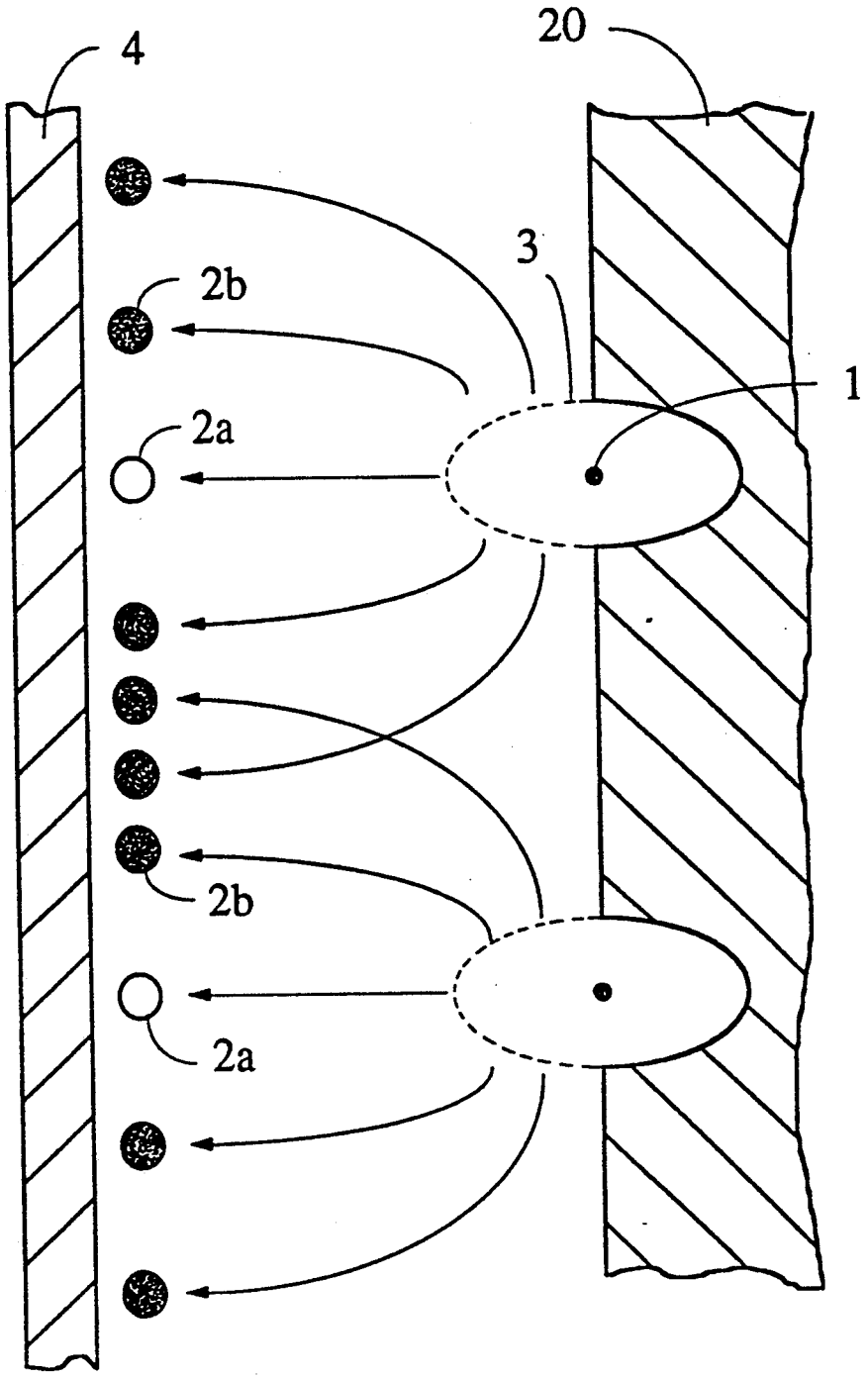
FIG. 4 (PRIOR ART)
FIG. 4 is an illustration showing a movement of the electrons attracted from the cover electrodes 3.
Figure 5:
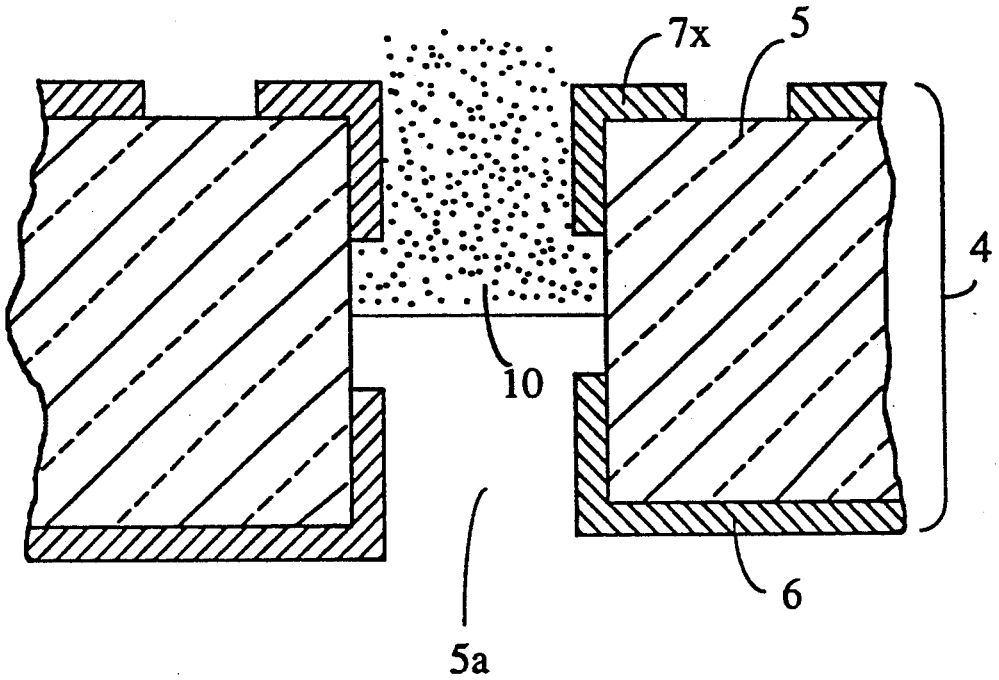
FIG. 5 (a) (PRIOR ART)
FIGS. 5*a* and 5*b* are illustrations showing a movement of the electrons passing through the control electrode 4.
Figure 5:
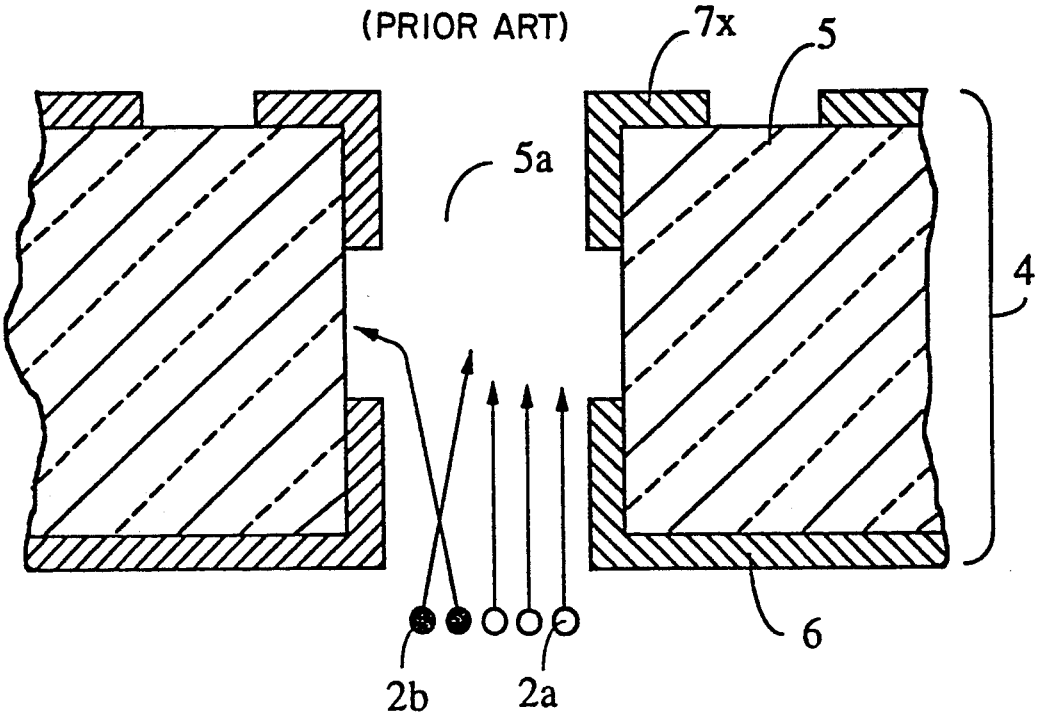
FIG. 5 (b) (PRIOR ART)
Figure 6:
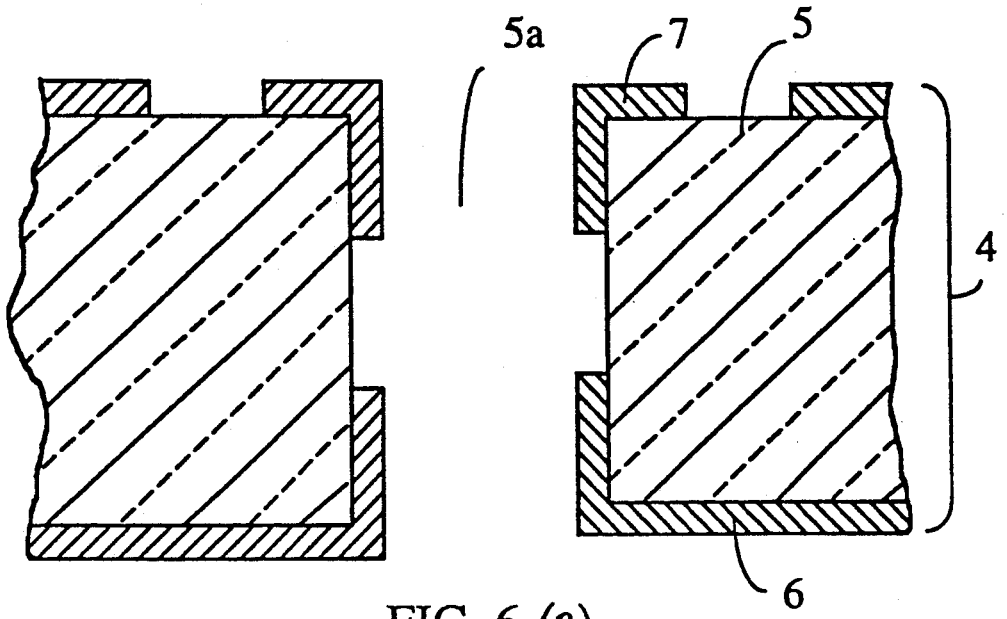
FIG. 6 (a) (PRIOR ART)
FIGS. 6*a* and 6*b* are illustrations showing a movement of the electrons passing through the control electrode 4.
Figure 6:
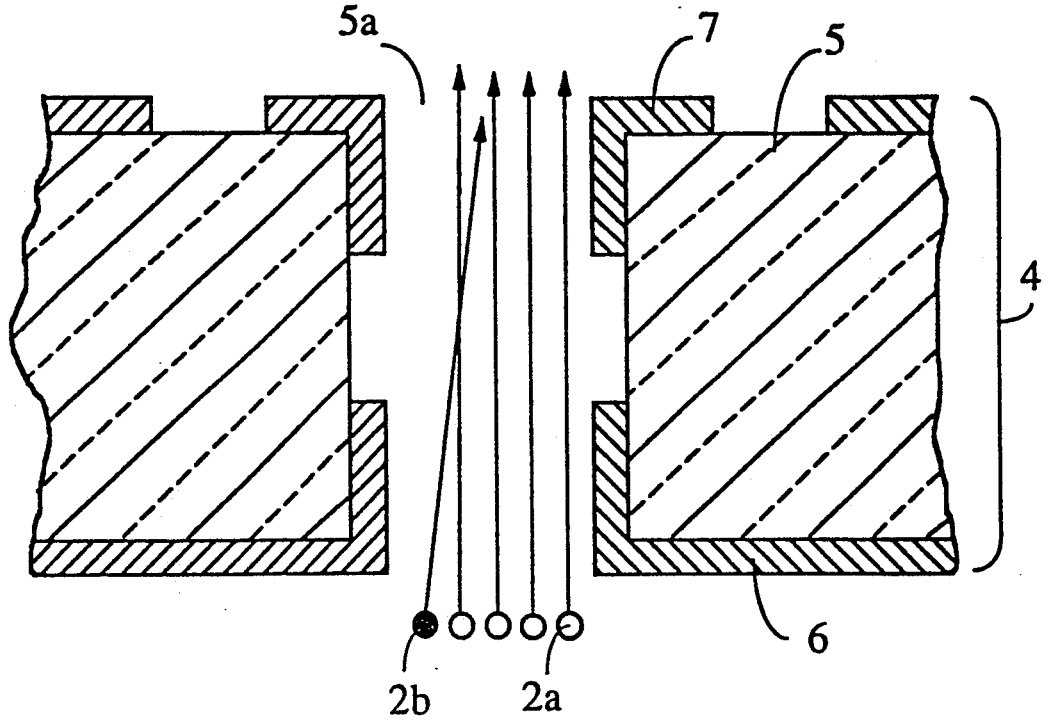
FIG. 6 (b) (PRIOR ART)
Figure 7:
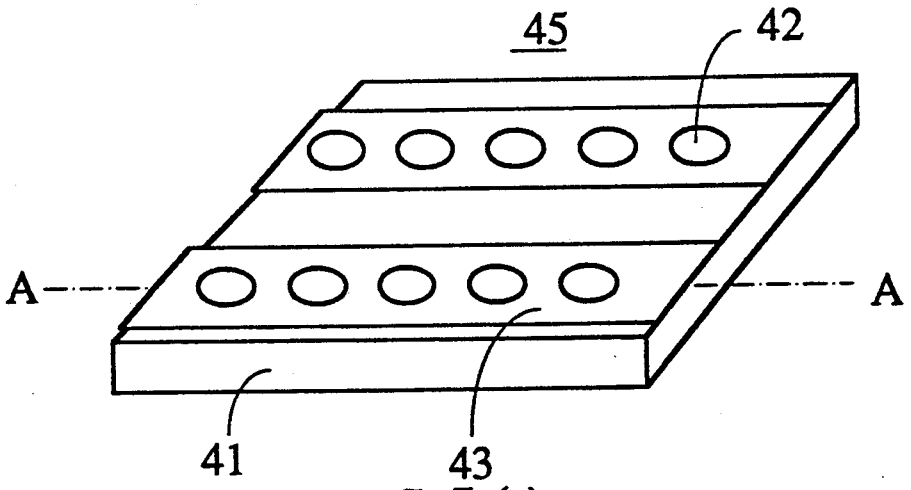
FIG. 7 (a) (PRIOR ART)
FIGS. 7*a*–7*c* show one of the prior art manufacturing methods of the control electrode.
Figure 7:
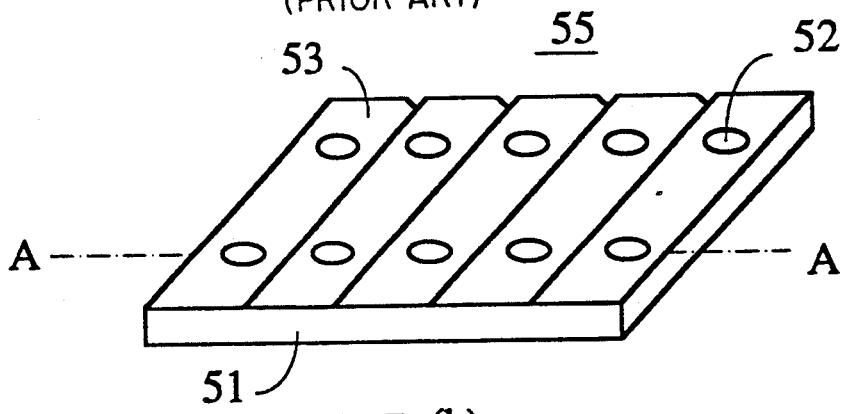
FIG. 7 (b) (PRIOR ART)
Figure 7:
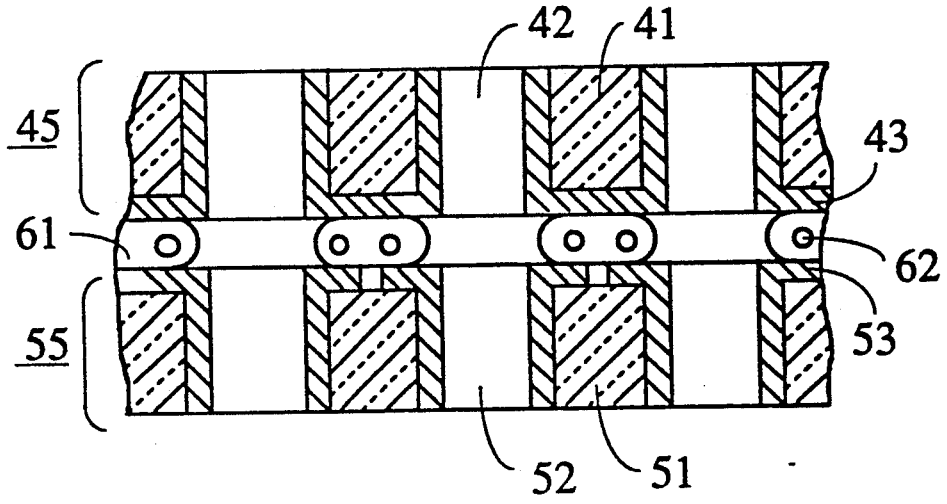
FIG. 7 (c) (PRIOR ART)
Figure 8:
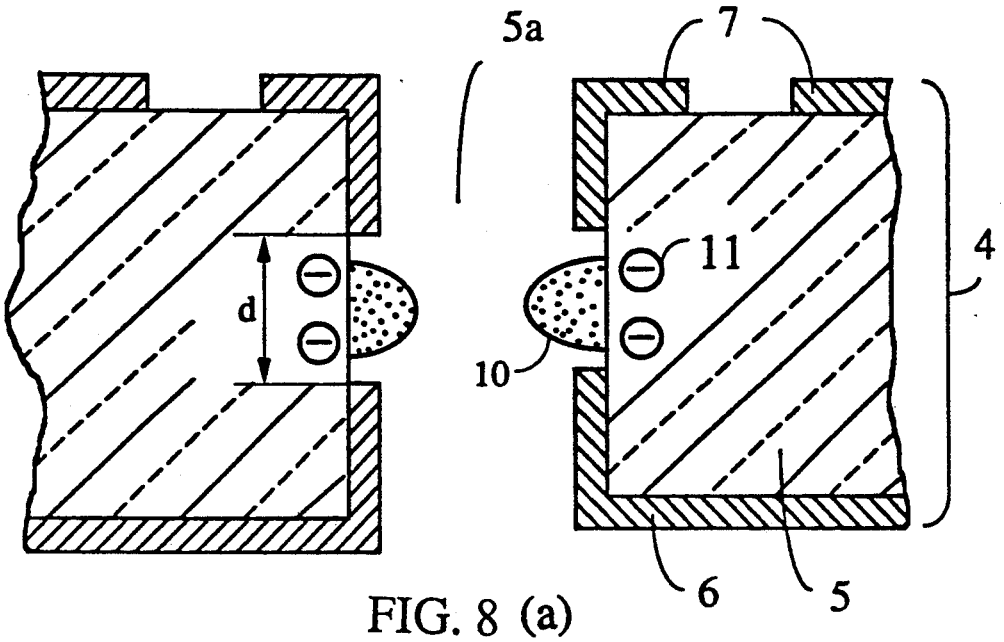
FIG. 8 (a) (PRIOR ART)
FIGS. 8*a* and 8*b* are illustrations showing a movement of the electrons passing through the control electrode 4.
Figure 8:
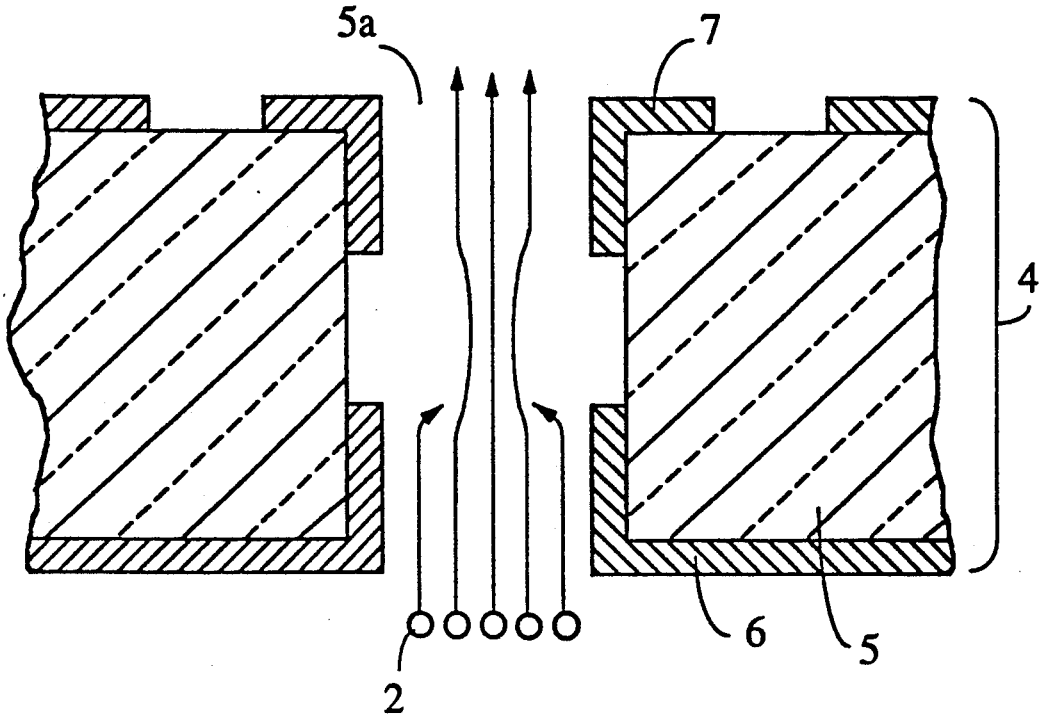
FIG. 8 (b) (PRIOR ART)
Figure 9:
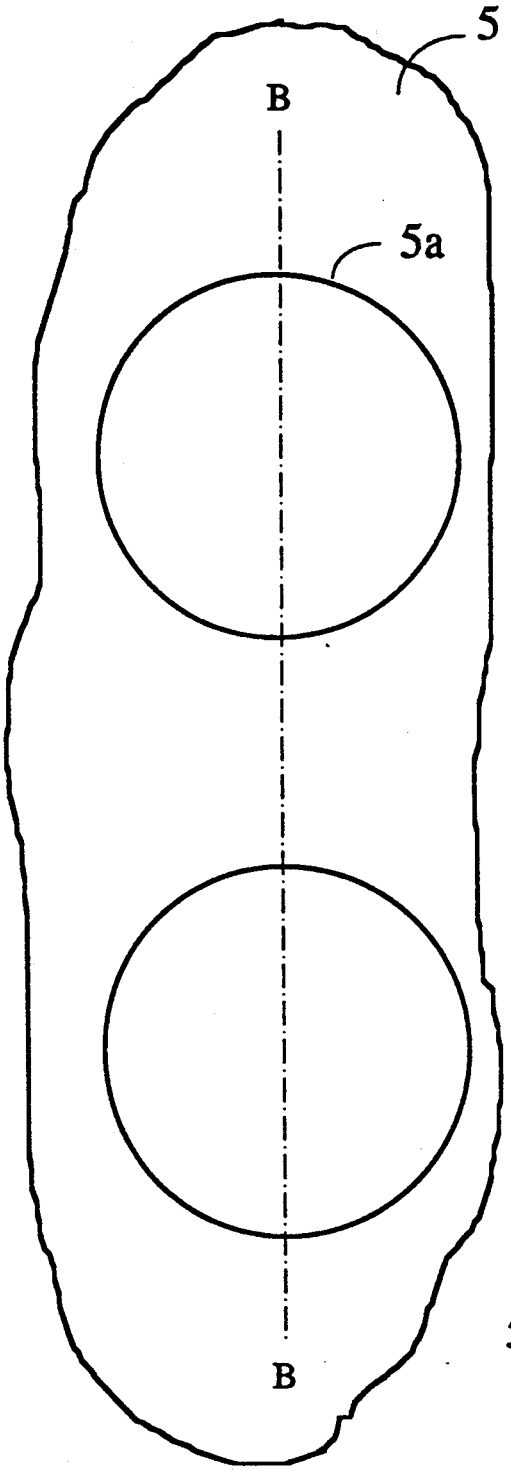
FIG. 9 (a) (PRIOR ART)
FIGS. 9*a* and 9*b* are enlarged sectional views of the prior art control electrode.
Figure 9:
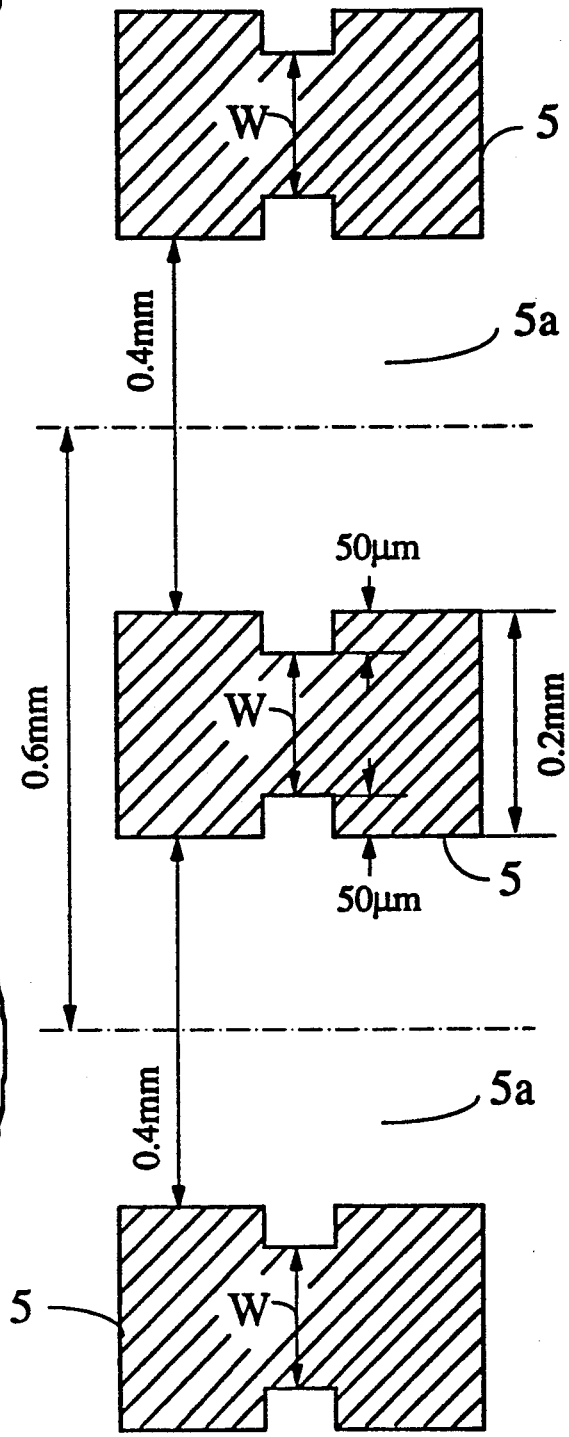
FIG. 9 (b) (PRIOR ART)

As shown in FIG. 1, since the exposed surface of the insulated substrate is covered by the resistive film such as the amorphous silicon film 12, if the electrons hit the wall of the electron pass hole, the surface of the insulated substrate is not charged by the accumulation of the electrons. Since the electrons are able to pass through almost all electron pass holes 5(*a*), as shown in FIG. 4, a large current beam and a high intensity of the screen can be obtained. Further, since the influence of charging can be neglected, a length of the exposed part of the insulated substrate 5 need not be controlled accurately in contrast with that of the prior art. Therefore it is easy to mass-produce the display screen by the present invention.

One of the embodiments for manufacturing the control electrode 14 of the present invention is explained hereinafter. The conductive substrate covered by the stainless or aluminum film is etched for making the electron pass hole 5*a* where the electrons pass through. Then the substrate 5 is covered with the insulated film for all surfaces of the insulated substrate including the inner wall surface of the electron pass hole 5*a*. For example, in case of aluminum, an alumite layer having the thickness of about 30 μm is formed on the insulated substrate using the anodizing method.

On the bottom surface insulated substrate 5, a first control conductive film 6, which is divided into many pieces corresponding to each column of the electron pass hole 5*a* and consists of the conductive material such as nickel, is coated by the electroless plating methods and masking method. In the same way, on the top surface of the insulated substrate 5, a second control conductive film 7 with the exposed part of the substrate, which is divided into many pieces corresponding to each row of the electron pass hole 5*a* and consists of the conductive material such as nickel, is coated by the electroless plating methods and masking method. The exposed part of the insulated substrate is formed for insulating the adjacent control conductive film. As the control electrodes are formed as described above, the voltage can be applied to each conductive films 6 and 7 independently for each column and each row.

Then, the semiconductor film of the amorphous silicon (α-Si) is formed on the surface of the insulated substrate and electron pass hole using plasma CVD method. It takes about 40 minutes for forming the film of 1 μm thickness. The resistivity of the amorphous silicon is able to control arbitrarily between $10^2 \sim 10^{10}$ Ωcm by the doping of boron or phosphorous. If the temperature is over 400° C., the film may endure against the heating by the baking during the vacuum exhausting. The film thickness may be also controlled like that of the surface of the substrate. The semiconductor is used for a resister film, since the production engineering for controlling the forming velocity, resistivity and heat resistance is already established, and it is easy to form the desired film shape. In the embodiment, since the insulated substrate is coated with the conductive film which can be applied excessively by the electron control voltage, it is easier to mass-produce the control electrode having the fine structure in contrast with the prior art.

When the different voltages are applied to the electrodes 6 and 7, a leak current flows in the inner wall of the electron pass hole 5*a* between the electrodes 6 and 7 through the resistive film 12. If different voltages are applied between the two adjacent electrodes 6, a leak current flows through the resistive film. Therefore, if the resistivity of the film is too low, the leak current will increase and the load of the power source will also increase. If the resistivity of the film is too high, the leak current will decrease and the surface of the insulated substrate will be charged. The film thickness is restricted from the hole diameter and forming velocity of the film. From these reasons, a desirable resistivity of the film is within a range of $10^2 \sim 10^9$ Ωcm. In this embodiment, the film resistivity was selected to be $10^5$ Ωcm, and the film thickness was selected to be 1 μm. The total leak current of the control electrodes was in the order of several mA.

In the flat display device constructed by the above method, the light generation of the florescent body 9 is controlled for each picture element and the desired picture can be obtained by applying the voltage which controls the pass of the electrons to the first and the second control conductive films. In the present embodiment, a superior feature is obtained from the observation of the light generation state of the fluorescent body under the same condition of voltage applied to the first and the second control conductive films 6,7 and the ON-OFF operation in contrast with the prior art.

In the above embodiment, the round hole is used for the shape of the electron pass hole, but the same effect may be obtained if the electron pass hole is rectangular shape or other shapes.

In the above embodiment, the first and the second control conductive films are coated in the inner wall of the electron pass hole 5*a*, but the conductive film may be coated only on the top surface or the bottom surface of the insulated substrate 5.

In the first embodiment, the surface insulated film 5 consists of an alumite layer coated on the surface of the aluminum conductive substrate. But, the coating of the surface insulated film 5 may consist of an oxide, a nitride or a resin such as a polyimide coated on the surface of a metal other than the aluminum. Or the surface insulated film 5 may consist of only an insulated glass or an insulated ceramic. From the view point of etching or performance, the most preferable surface insulated film 5 would consist of the metal substrate, since the metal substrate is easily etched by an etching method during making the electron pass hole.

In the above first embodiment, since the second control conductive film group 7 is coated until in the inner wall of the electron pass hole 5*a*, the electromagnetic lens is formed inside the electron pass hole (depth direction), and the electrons passed through the electron pass hole are influenced by the diverging force. In order to prevent the above effect, a focusing electrode plate, which converges the electrons passed through the electron pass hole, may be arranged between the front glass 8 and the control electrode 14. Using the focusing electrode plate, the electrons are prevented from diverging and the picture quality such as the contrast will increase.

In the above first embodiment, the resistive film is formed on all surfaces of the substrate including the inner wall of the electron pass hole. But, the resistive film may be formed only on the inner wall of the electron pass hole or both on the wall of the electron pass hole and on one side surface of the substrate. The above case has substantially the same effect as the present embodiment.

Second Embodiment

In the first embodiment, the thin films 6 and 7 comprising the conductive material are firstly formed on the surface of the surface insulated substrate 5 and on the inner wall of the electron pass hole 5*a*, then the resistive film 12 is formed on thin films 6 and 7.

But in the second embodiment, the resistive film is firstly formed on the surface of the surface insulated substrate 5 and on the inner wall of the electron pass hole 5*a*, then the thin films 6 and 7 comprising the conductive material are formed on that resistive film 12. The second embodiment has the same effect as the first embodiment.

In the above embodiments, the resistive film 12 having the resistivity of $10^5$ Ωcm and the thickness of 1 μm is formed by the plasma CVD method using the amorphous silicon. But, the other methods such as a heat CVD method may be used and the other materials such as a silicon carbide (SiC) and chromium oxide may be used. The resistivity and the film thickness is not restricted by the value indicated in the embodiments.

That is, the function of the film is to prevent the charging and to maintain the electric potential between the electrodes 6 and the electrodes 7. Therefore, if the same function is satisfied, the feature such as the material, the film thickness, the coating method and the resistivity is not restricted by the value indicated in the above embodiments. And even in that cases, the same effect may be substantially obtained.

What is claimed is:

1. A flat display device having a cathode means; control electrodes having electron pass holes for controlling electron beams generated on the cathode means and passed through the electron pass holes; a front glass having coated fluorescent materials for generating light by the irradiation of electrons, which front glass is arranged substantially in parallel to the control electrodes, the display device comprising:

a substrate through which the electron pass holes are located and to which the control electrodes are coupled, the substrate having exposed portions where the control electrodes are absent; and a resistive film coated on the exposed portions of the substrate so as to inhibit charge build-up on the substrate when the electrons pass through the pass holes.

2. The flat display device of the claim 1, wherein the resistive films of the control electrodes consist of semiconductor.

3. The flat display device of the claim 1 or claim 2, wherein the control electrodes consist of conductive material films formed on the inner wall of the electron pass holes, or on the surface of the surface insulated substrate and on the inner wall of the electron pass holes, and resistive films formed on said conductive material films.

4. The flat display device of the claim 1 or claim 2, wherein the control electrodes consist of resistive films formed on the inner wall of the electron pass holes, or on the surface of the surface insulated substrate and on the inner wall of the electron pass holes, and conductive material films formed on said resistive films.

5. A flat display device comprising:

cathode means for generating electron beams;

a substrate having holes therein through which electrons of the electron beams pass;

control electrodes on the substrate and partially covering the substrate along the holes leaving exposed areas of the substrate within the holes;

display means for illuminating upon receiving the electrons after passing through the holes; and a film coating the exposed areas of the substrate so as inhibit charge build-up on the substrate upon passage of the electrons through the holes.

6. A flat display device as claimed in claim 5 wherein the film includes an amorphous silicon film.

7. A flat display device as claimed in claim 6 wherein the film includes a resistivity of approximately $10^5$ Ωcm.

8. A flat display device as claimed in claim 5 wherein the control electrodes include legs extending toward one another defining a gap therebetween, the exposed area being located within the gap.

9. A flat display device as claimed in claim 1 wherein the cathode means includes linear hot cathodes.

10. A flat display device as claimed in claim 1 wherein the control electrodes include legs extending toward one another defining a gap therebetween, the exposed area being located within the gap.

11. A flat display device as claimed in claim 9 wherein the control electrodes include legs extending toward one another defining a gap therebetween, the exposed area being located within the gap.

12. A flat display device as claimed in claim 10 wherein the film includes an amorphous silicon film.

13. A flat display device as claimed in claim 10 wherein the film includes a resistivity of approximately $10^5$ Ωcm.

14. The flat display device as claimed in any one of claims 9, 10 or 12 wherein the control electrodes consist of conductive material films formed on the inner wall of the electron pass holes, or on the surface of the insulated substrate and on the inner wall of the electron pass holes, and resistive films formed on said conductive material films.

15. The flat display device as claimed in any one of claim 9, 10 or 12, wherein the control electrodes consist of resistive films formed on the inner wall of the electron pass holes, or on the surface of the insulated substrate and on the inner wall of the electron pass holes, and conductive material films formed on said resistive films.

* * * * *